United States Patent [19]

Nagao et al.

[11] Patent Number: 4,635,509

[45] Date of Patent: Jan. 13, 1987

[54] BOTTLE OPENING MACHINE

[75] Inventors: Masami Nagao, Miwa; Tadakazu Oosawa, Takasaki, both of Japan

[73] Assignee: Kirin Beer Kabushiki Kaisha, Tokyo, Japan

[21] Appl. No.: 735,865

[22] Filed: May 20, 1985

Related U.S. Application Data

[63] Continuation of Ser. No. 452,877, Dec. 27, 1982, abandoned.

[30] Foreign Application Priority Data

Dec. 28, 1981 [JP] Japan ..... 56-214958

[51] Int. Cl.[4] ..... B67B 7/00

[52] U.S. Cl. ..... 81/3.2; 53/381 A

[58] Field of Search ..... 81/3.2; 53/381 A

[56] References Cited

U.S. PATENT DOCUMENTS 3,133,394 5/1964 Rayl ..... 53/381 A
3,237,289 3/1966 Pearson et al. ..... 81/3.2 X
3,545,174 12/1970 Randrup ..... 81/3.2 X

*Primary Examiner*—Frederick R. Schmidt
*Assistant Examiner*—Debra S. Meislin
*Attorney, Agent, or Firm*—Ladas & Parry

[57] ABSTRACT

An improved bottle opening machine for removing crown caps from the head portions of empty bottles in bottle cases without any damage or chipping on the bottle heads as the bottle cases are conveyed on a conveyance system in an end-to-end relation. The improvement consists in that cap removing operation is carried out by way of the steps of engaging cap removing parts to the crown caps on the bottle heads in an area where the circular movement track of the cap removing parts is united with the linear movement track of the bottle heads in the tangential relation, removing the crown caps from the bottle heads under the influence of a moment caused when the former is gradually parted away from the latter and releasing the removed crown caps from the cap removing parts. To ensure that the cap removing parts are correctly engaged with the bottle heads as the rotary disc is rotated, there is provided at least one synchronizing means of which guide recesses are adapted to be simultaneously engaged both the rear end of the preceding bottle case and the fore end of the following case as they are conveyed on the conveyance system. The cap removing parts are caused to rotate by line pressure transmitted from the conveyance system via the bottle case without a specific driving mechanism.

9 Claims, 14 Drawing Figures

BOTTLE OPENING MACHINE

This is a continuation of co-pending application Ser. No. 452,877 filed on Dec. 27, 1982, now abandoned.

BACKGROUND OF THE INVENTION

The present invention relates to a bottle opening machine for removing crown caps from the head parts of bottles contained in a bottle case and more particularly to an improved bottle opening machine in which the crown caps are continuously and automatically removed from the opening rims of the bottles in the bottle case as it is conveyed on a conveyance system.

As is well known, beer, refreshing drink or the like filled in bottles are delivered from a bottling factory to a consumer market and after the consumers enjoy them the empty bottles are recovered for bottling beer, refreshing drink or the like again. It is often found that among the recovered empty bottles (as contained in the bottle case) some ones are manually capped with crown caps. This causes necessity for removing these caps from the bottles in a preliminary process before they are transferred to a bottling line in the bottling factory.

A hitherto known bottling machine is generally constructed such that cap removing operation is practiced by way of the steps of lowering a pair of pawl means to the position corresponding to the lip portion of the crown cap to be removed, allowing the pair of pawl means to be actuated until they are engaged to the lip portion and then forcibly raising up the crown cap while they hold the latter therebetween.

On the other hand, a bottle opening machine of the type including cap removing parts adapted to carry out a circular movement is disclosed in Japanese Laid-Open Patent No. 17,983/77 (corresponding to Japanese Patent Application No. 93,529/55). Specifically, the conventional bottle opening machine is constructed such that each cap removing part turns its circular movement to a linear movement at the cap removing area. That is, its cap removing operation is practiced by the steps of lowering a pair of pawl means displaceably held on the cap removing part until they are engaged to the lip portion of the crown cap, and forcibly raising up the crown cap while they hold the cap therebetween with the opening rim of the bottle depressed so as to prevent the latter from being lifted above the bottle case.

However, it is pointed out as a drawback with respect to the above-described conventional bottle opening machine that the cap removing operation requires a large amount of power consumption due to the arrangement that the pair of pawl means are raised up while the bottle neck is depressed by means of a retainer and there is a fear of causing damage or chipping on the bottle neck while the crown cap is raised up together with the pair of pawl means engaged thereto.

Another drawback inherent to the conventional bottle opening machine is that due to the upward and downward movements of the pawl means, the pawl means stop at both the upper and lower dead points, accordingly, the cap removing operation is intermittently practiced. That causes a low efficiency for removing the crown caps. Still another drawback is that to prevent the bottle from being lifted above the bottle case while cap removing is effected by means of the pair of pawls in the cap removing part, there is a necessity for a bottle neck retainer and thereby the bottle opening machine becomes incomplicated, resulting in an increased manufacturing cost.

SUMMARY OF THE INVENTION

It is an object of this invention is to provide an improved bottle opening machine in which cap removing is effected by utilizing a moment which is generated as a circular movement track of a pawl means in the cap removing part is increasingly parted away from a linear movement track of the bottle head of the empty bottle whereby crown caps are continuously and smoothly removed from the bottle opening rims of the bottles in the bottle case at a high efficiency by means of simply designed cap removing parts without any fear of causing damage or chipping on the bottle heads during the cap removing operation.

According to this invention there is provided a bottle opening machine for removing crown caps from the bottle heads of empty bottles contained in bottle cases which are conveyed on a conveyance system one after another in an end-to-end relation, essentially comprising a rotary member rotatably mounted on a frame structure, a plurality of cap removing parts disposed circularly around the periphery of said rotary member so that they can be engaged with the respective heads of the bottles in bottle cases at a predetermined position, each of the cap removing parts including a pawl means adapted to be engaged to the crown cap capped thereon, cap removing operation being carried out by engaging each pawl means in the cap removing parts to the crown caps on the bottle heads in an area where the linear movement track of the bottle heads of the empty bottles in the bottle cases and the circular movement track of the pawl means on the cap removing parts are united with one another in the tangential relation to exert a moment on the caps thereby to remove them from the heads of the bottles which moment is caused by the circular movement track being gradually parted away from the linear movement track past the aforesaid area as the bottle cases are conveyed further on the conveyance system.

The nature, utility and further features of this invention will be apparent from the following detailed description made with respect to preferred embodiments of the invention when it is read in conjunction with the accompanying drawings.

DETAILED DESCRIPTION OF THE INVENTION

Figure 1:
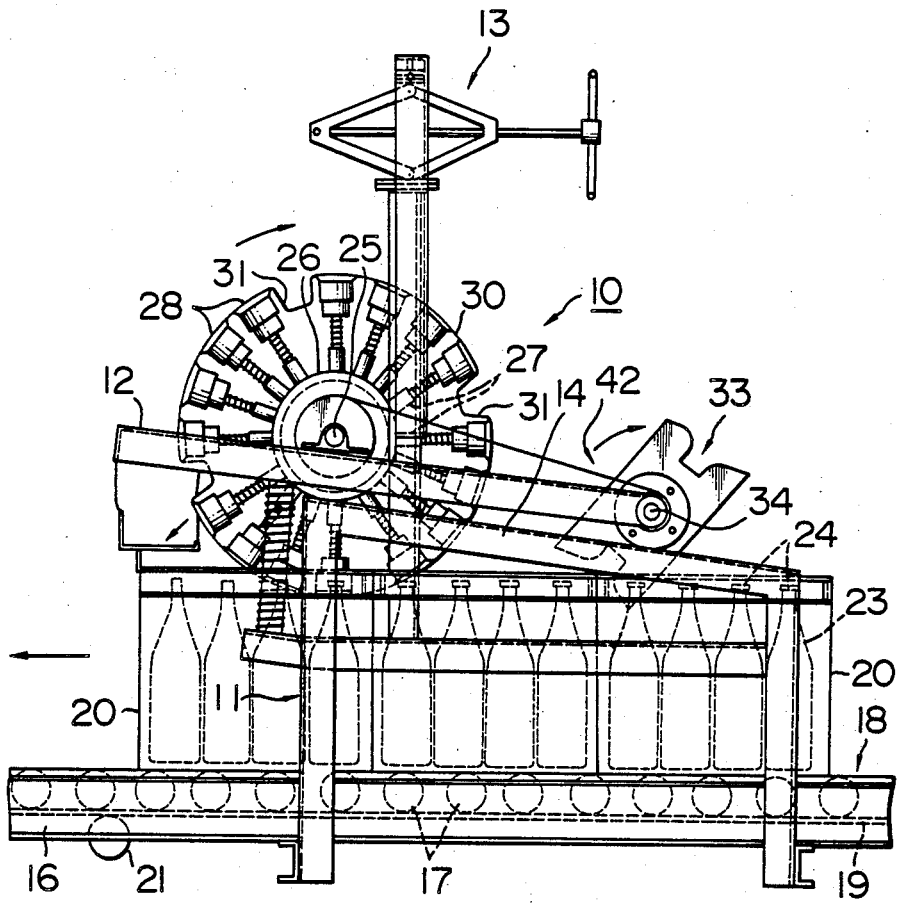
FIG. 1 is a side view of the whole bottle opening machine in accordance with an embodiment of the present invention.
Figure 2:
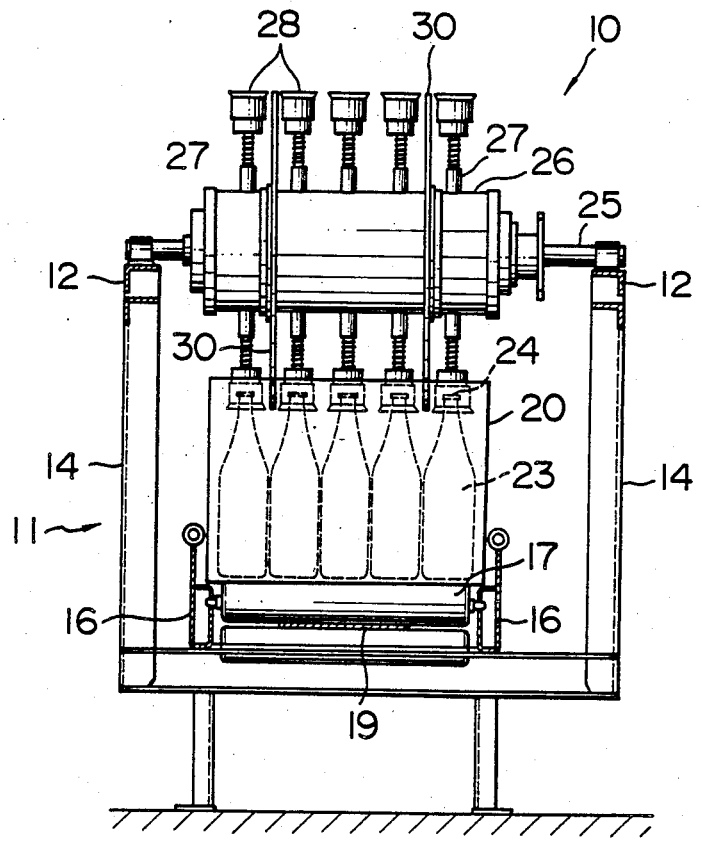
FIG. 2 is a front view of the bottle opening machine as seen from the left side in FIG. 1 without a raising and lowering mechanism, a cap receiving basin, and a synchronizing mechanism for the purpose of simplifying illustration.
Figure 3:
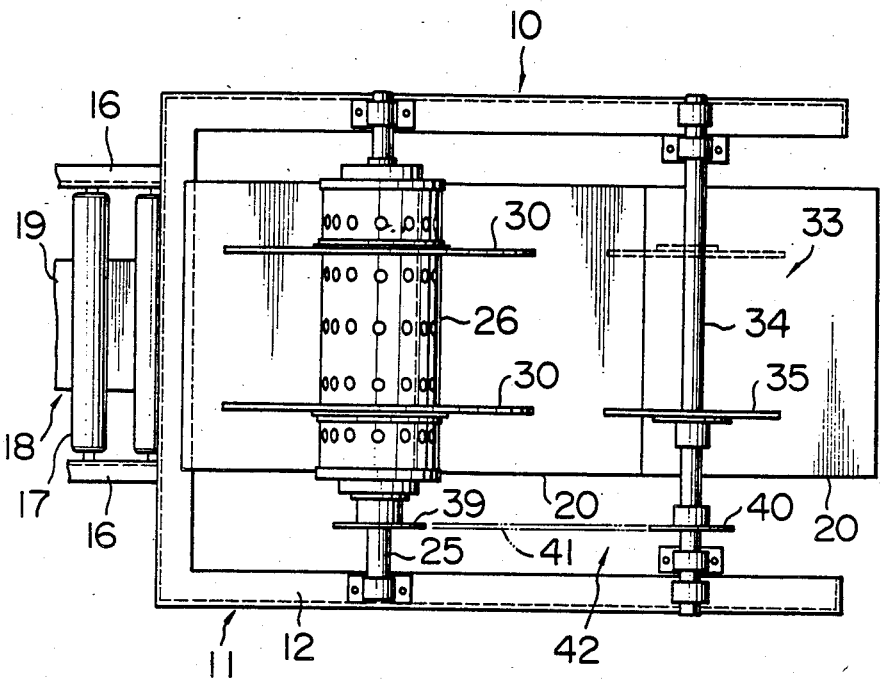
FIG. 3 is a plan view of the bottle opening machine in FIG. 1 without cap removing parts and arms.

Referring first to FIGS. 1 to 3, reference numeral 10 generally designates a bottle opening machine in accordance with an embodiment of the invention. As will be apparent from the drawings, the bottle opening machine 10 has a movable frame 12 constituting a substantial part of a framework 11 designed in a frame structure. The movable frame 12 is vertically displaceable relative to a stationary frame 14 with the aid of a conventional raising and lowering mechanism 13 such as hydraulic jack for a motorcar or the like so that the height of a rotary drum 26 is adjusted by means of said raising and lowering mechanism 13.

On the other hand, between both the sides of the framework 11 are horizontally arranged a pair of support frames 16 adapted to rotatably support a number of rollers 17 therebetween. A conveyor 18 is formed by the rollers 17 disposed in an equally spaced relation in the longitudinal direction. Each of the rollers 17 comes into frictional contact with an endless belt 19 so that they are rotated by operating it by means of a driving power source which is not shown in the drawings. A container case 20 is placed on the series of rollers 17 whereby it is moved on the roller conveyor 18 as they are rotated. It should be noted that pressure rollers 21 one of which is illustrated in the drawings are arranged beneath the endless belt 19 so as to urge the latter against the rollers 17 and thereby generate sufficiently high frictional contact force to be exerted on them.

Bottles 23 recovered from consumers are contained in the case 20 to be fed on the roller conveyor 18. The bottles 23 include a beer bottle, a refreshing drink bottle and others. Among the recovered bottles 23 there are found a lot of bottles fitted with a crown cap 24.

As is best seen from FIG. 2, the bottle opening machine 10 is supported by means of a support shaft 25 horizontally extending across the roller conveyor 18 at an elevated position relative to the latter. The support shaft 25 is fixedly mounted on the movable frames 12 and the cylindrical rotary drum 26 is rotatably fitted on the support shaft 25. A number of arms 27 arranged (sixteen arms in the illustrated embodiment) in the circumferential direction are fitted onto the drum 26 in the radial direction. Each of the arms 27 have a crown cap removing part 28 carried at their free end. The cap removing parts 28 are located in the circumferential direction so as to exactly correspond to the position of the bottle heads of the bottles 23 contained in the case 20. Specifically, in the illustrated embodiment sixteen cap removing parts 28 are arranged in the circumferential direction to form a unit of the parts so that they are engaged to the crown caps 24 on the bottles 23 so as to remove the former from the latter.

Figure 4:
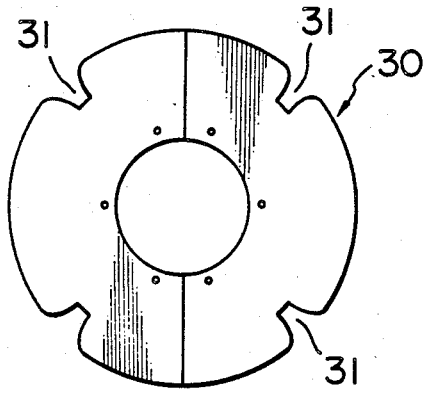
FIG. 4 is a side view of a synchronizing disc to be fixedly mounted on a cylindrical rotary drum of the bottle opening machine in FIG. 1, shown in an enlarged scale.

Further, the cylindrical rotary drum 26 has a pair of synchronizing discs 30 fixedly mounted thereon. The synchronizing discs 30 are positioned between two adjacent units of cap removing parts 28. In the illustrated embodiment one of the synchronizing discs 30 is positioned between the first and second units as seen from the left side of the drum 26 in FIG. 2, whereas the other one is located between the first and second units as seen from the right side. As shown in FIG. 4, each of the synchronizing discs 30 has synchronizing recesses 31 formed in an equally spaced relation on the circumference of which circular pitch corresponds to the length of the bottle case 20. Each of the synchronizing recesses 31 is adapted to be engaged to the rear end of the preceding bottle case and the fore end of the following bottle case simultaneously whereby the respective cap removing portions 28 are correctly engaged to the head parts of the bottles 23 in the case 20. Owing to the engagements as described above the bottle opening machine 10 is subjected to line pressure transmitted from the roller conveyor 18 via the bottle cases 20 whereby each drum 26 is driven by the line pressure.

Figure 5:
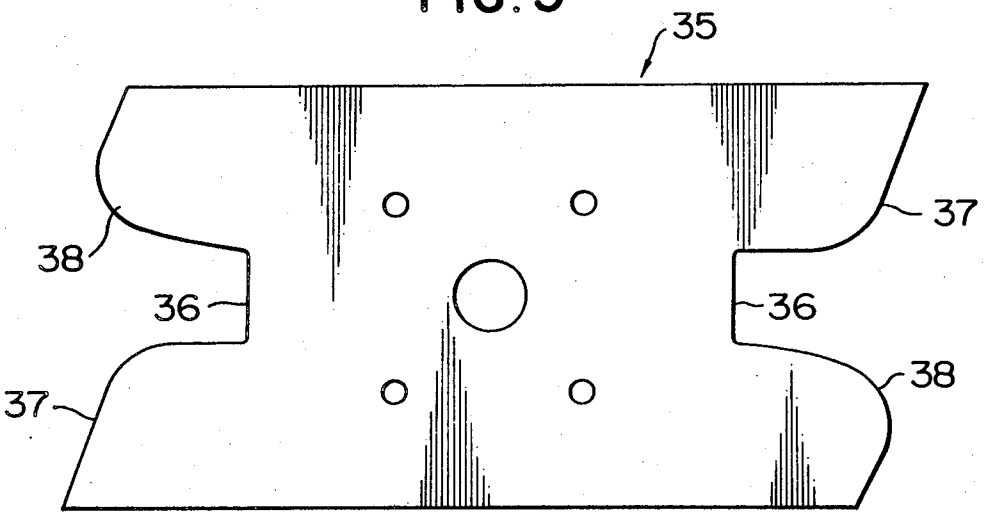
FIG. 5 is a side view of a synchronizing plate for the synchronizing mechanism on the bottle opening machine in FIG. 1, shown in an enlarged scale.

In view of the case where the recess 31 on the synchronizing disc 30 fails to be engaged to the upper end part of the bottle case 20 for a reason there is provided a synchronizing mechanism 33 at a upstream position relative to the drum 26 by means of which the rotary drum 26 is rotationally driven under the line pressure exerted thereon. As illustrated in FIGS. 1 and 3, the synchronizing mechanism 33 includes a rotary shaft 34 and a synchronizing plate 35 fixedly mounted on the rotary shaft 34. The synchronizing plate 35 has a substantially rectangular configuration as shown in FIG. 5 which is symmetrical as seen in the radial direction relative to the axis of the rotary shaft 34. On both the shorter sides of the synchronizing plate 35 are formed synchronizing recesses 36 which are adapted to be engaged to the top of the bottle case 20. On the both sides of the synchronizing recess 36, a leading guide edge 37 and a trailing guide edge 38 are formed. As the bottle case 20 is fed forward on the roller conveyor 18, it is first engaged to the leading guide edge 37 and then engaged to the synchronizing recess 36. Finally it is engaged to the trailing guide edge 38. During the engagement as described above the synchronizing plate 35 is subjected to line pressure which is transmitted from the roller conveyor 18 via the bottle case 20 whereby it is rotationally driven by the line pressure.

The rotary shaft 34 is operatively connected to the cylindrical rotary drum 26 by way of a power transmission mechanism comprising sprockets 39 and 40, an endless chain 41 and others so that both the synchronizing plate 35 and the drum 26 are synchronously rotated in such a manner that the former is rotated, for instance, through two revolutions while the latter is rotated through revolution. Thus, the bottle opening machine 10 is operated by the combination of the synchronizing plate 35 and the drum 26 in that way.

Figure 6:
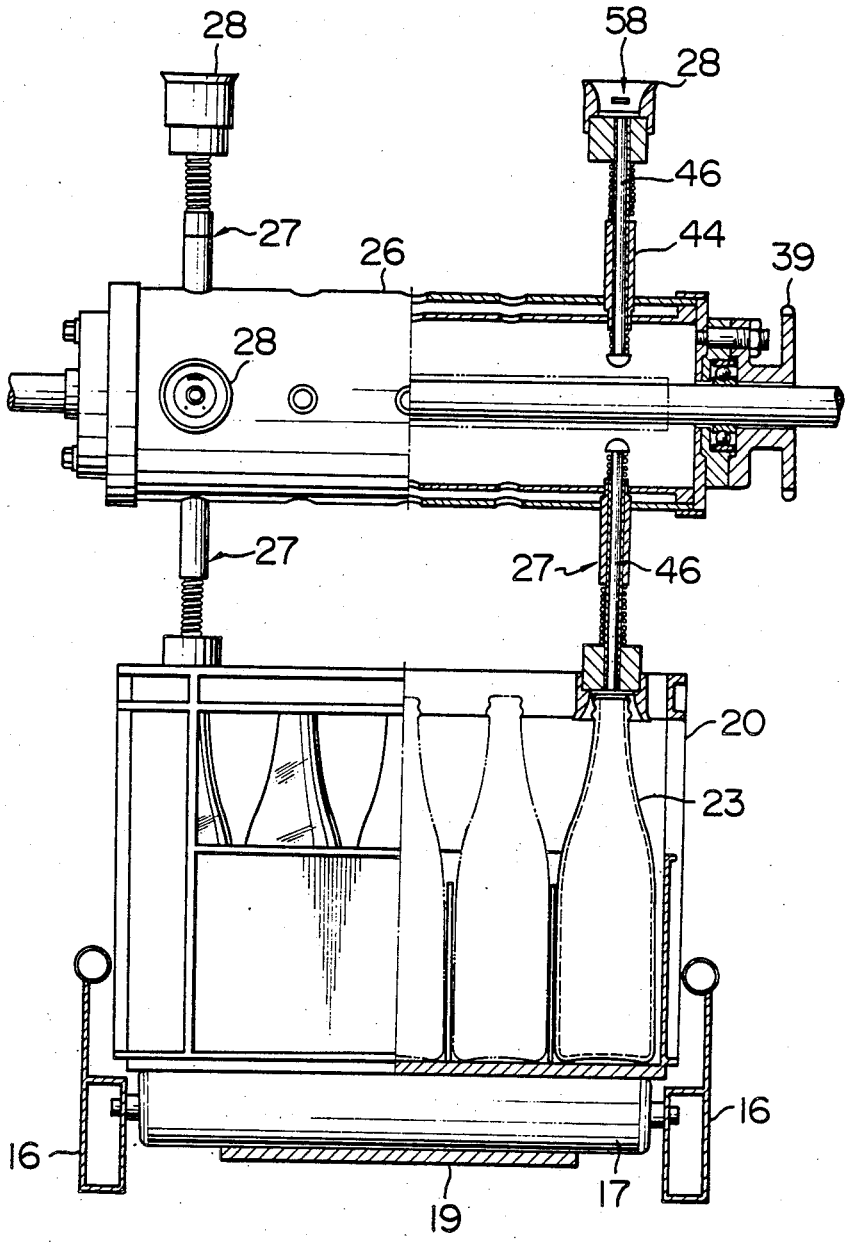
FIG. 6 is a partially sectioned front view of the bottle opening machine in FIG. 1, illustrating in an enlarged scale how arms and cap removing parts are fitted onto the cylindrical rotary drum.
Figure 7:
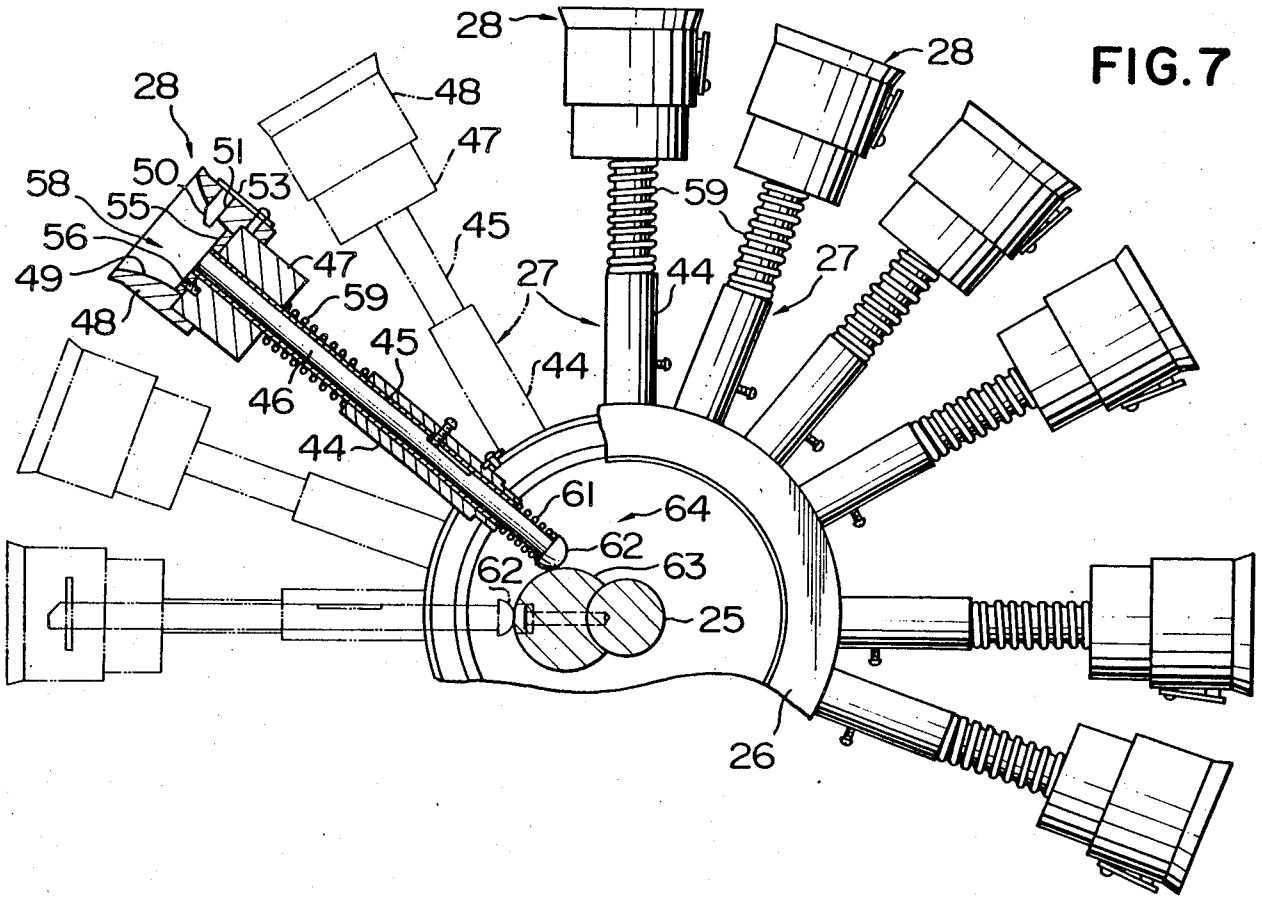
FIG. 7 is a partially sectioned side view of the cylindrical rotary drum with the arms and the cap removing parts arranged thereon in FIG. 6, shown in a scale larger than in FIG. 5.

On the other hand, the arms 27 radially mounted on the cylindrical rotary drum 26 are constructed in such a manner as illustrated in FIGS. 6 and 7. Specifically, each of the arms 27 includes a holding sleeve 44 fixedly secured to the drum 26 and a guide tube 45 fitted into the holding sleeve 44. Further, a thrust rod 46 is slidably inserted through the guide tube 45.

As is apparent from the drawings, the cap removing parts 28 are firmly attached to the free ends of the guide tubes 45. Each of the cap removing parts 28 includes a cylindrical member 47 and a guide head 48 integrally fitted onto the cylindrical member 47. The guide head 48 has a bell-shaped guide surface 49 formed on the inner wall and includes a pawl 50 projecting inward therefrom. The pawl 51 is freely slidable through a fitting hole 51. The fitting hole 51 extends through the circumferential wall of the guide head 48 and a leaf spring 53 is fixedly secured to the outer surface of the guide head 48. The rear end of the pawl 50 touches the leaf spring 53. Thus, the pawl 50 is normally urged in the inward direction under the resilient force imparted by the leaf spring 53.

At the bottom of the bell-shaped guide surface 49 in the guide head 48 is fixedly disposed a resilient member 55 made of synthetic resin or the like material which is effective in absorbing a shock. A permanent magnet 56 is dispsoed at a position located opposite to the pawl 50 relative to the axis of the thrust rod 46 so as to act as a crown cap holding mechanism 58 which serves to hold a removed crown cap in cooperation with the pawl 50. Preferably, the permanent magnet 56 is a high power magnet containing cobalt or the like as an alloying component.

Between the cylindrical member 47 and the holding sleeve 44 is interposed a coil spring 59 which serves to absorb an impact force exerted on the guide head 48. Due to the arrangement of a coil spring 61 the thrust rod 46 is normally held so as to assume a retracted position so that a head 62 at the innermost end of the thrust rod 46 is brought into contact against a camshaft 63. The camshaft 63 is fixedly mounted on the stationary support shaft 25 to carry out cam operation in such a manner that when the thrust rod 46 is urged outward against the resilient force of the coil spring 61 due to the engagement of the head 62 with the camshaft 63, its outermost end part is projected beyond the resilient member 55 whereby the crown cap 24 held by the cap holding mechanism 58 is disengaged therefrom. Thus, a crown cap disengaging mechanism 64 is constructed by a combination of the camshaft 63, the thrust rod 46 and the coil spring 61.

The crown cap 24 disengaged from the cap disengaging mechanism 64 is discharged and received in a crown cap receiving basin 65. As a result the crown caps 24 removed from the cap removing parts 28 are recovered into the cap holding basing 65 without any scattering around the drum.

Figure 8:
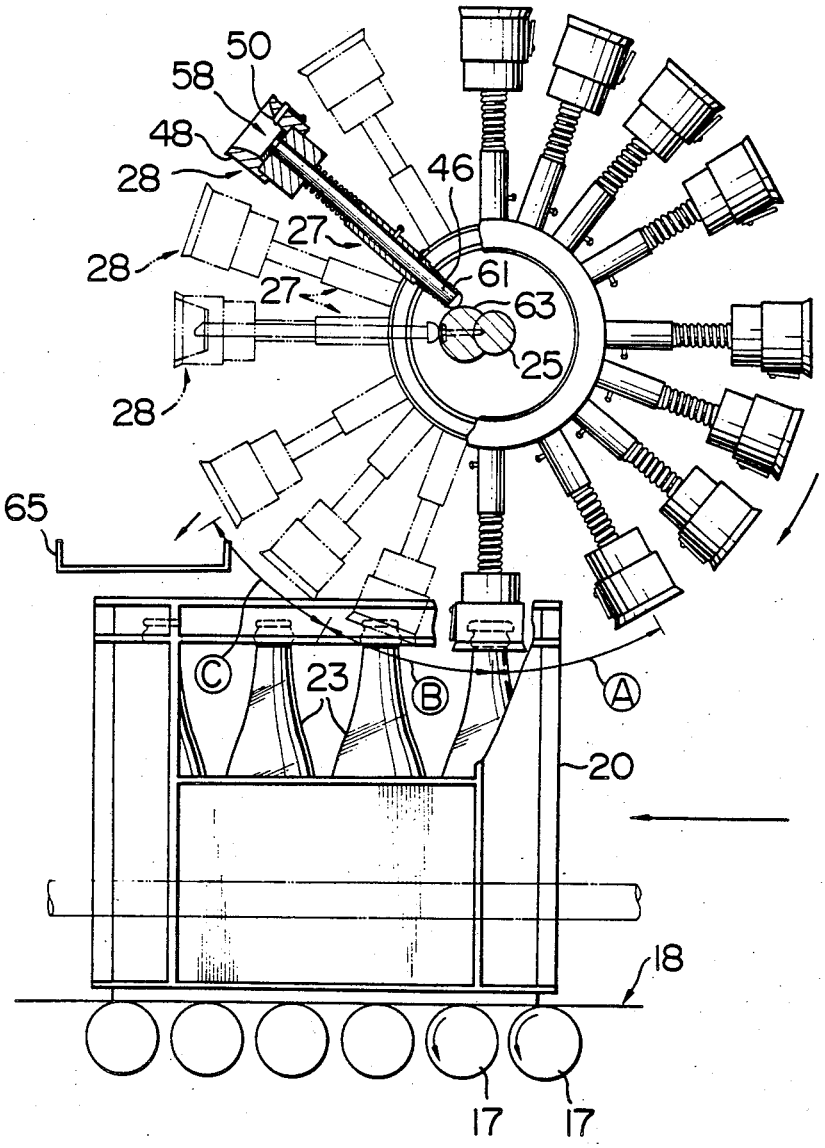
FIG. 8 is a partial side view of the bottle opening machine in FIG. 1, illustrating how cap removing operation is carried out as a bottle case is conveyed in the direction indicated by an arrow mark.
Figure 9:
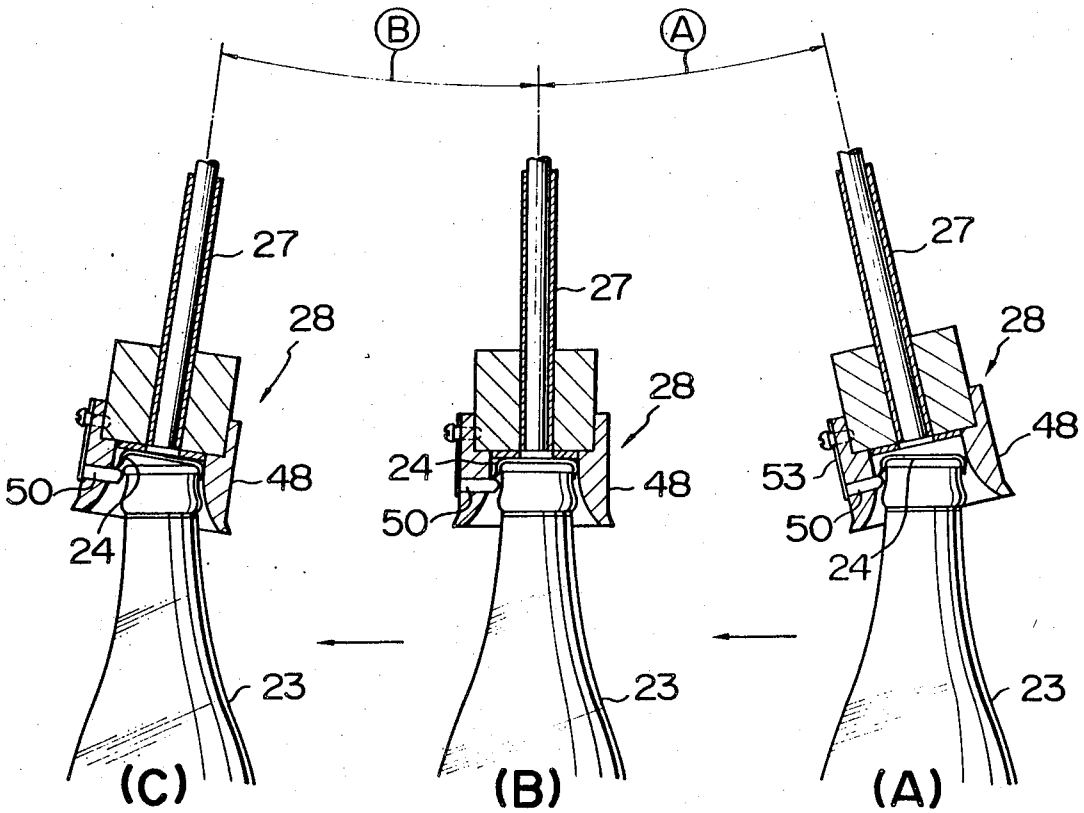
FIGS. 9(A), (B) and (C) are partially sectioned side views respectively, illustrating in an enlarged scale how the cap removing part is brought into engagement with the opening rim of the bottle with a crown cap capped thereon and then disengaged therefrom with the crown cap removed.

Next, crown cap removing operations will be described below with reference to FIGS. 1, 8 and 9.

A bottle case 20 with a lot of recovered bottle 23 contained therein is transferred on the roller conveyor 18 from the outside toward the bottle opening machine 10 and fed under the synchronizing plate 35 of the synchronizing mechanism 33. The bottle case 20 engages with the plate 35 before it is fed under the drum 26.

After moving past the synchronizing mechanism 33, the bottle case 20 is displaced to a bottle locating region A. At this time the fore end of the following bottle case and the rear end of the preceding one are engaged together to any one of the synchronizing recesses 31 on the synchronizing disc 30 or the synchronizing recesses 36 on the synchronizing plate 35, accordingly, each cap removing part 28 can be correctly engaged with the head of each bottle 23 in a synchronous relation.

FIG. 9(A) illustrates how the cap removing part 28 is correctly allocated to the head of the bottle 23 in the bottle head locating region A. After moving past the region A, the bottle 23 is further fed toward the position as illustrated in FIG. 9(B) where it is completely engaged to the cap removing part 28 in such a manner that the pawl 50 engages with the lip on the crown cap 24. Subsequently, the bottle 23 is transferred to the crown cap removing region B. As is readily apparent from the drawings, the region A indicated by FIGS. 9(A) and (B) is an area where the linear movement track of the bottle head in the case is gradually united with the circular movement track of the pawl 50 in the cap removing part 28.

As the cap removing part 28 is displaced to the crown cap removing region B, the circular movement track of the cap removing part 28 is gradually parted away from the linear movement track of the head of the bottle 23 whereby a moment is generated about a fulcrum on the crown cap, resulting in smooth disengagement of the latter from the bottle 23. The aforesaid fulcrum is located at the position opposite to the pawl 50 where the crown cap 24 is brought into contact against the inner wall of the guide head 48.

After the crown cap 24 is removed from the bottle head in the cap removing region B, it is carried to the crown cap holding region C (FIG. 8) while it is held by means of the cap holding mechanism 58. When it reaches the rear end of the cap holding region C, the cap disengaging mechanism 64 is actuated so as to allow the crown cap 24 held by the cap holding mechanism 58 to be discharged into the cap receiving basin 65. After the cap receiving part 28 completes the intended operation of removing the crown cap 24, it is rotationally displaced further until it is ready for starting the next operation.

As described above, the bottle opening machine 10 in accordance with the present invention is constructed such that cap removal is carried out merely by way of the circular movement of the respective cap removing part 28. Therefore, there is no necessity for any complicated raising and lowering mechanism constituting essential parts of the conventional bottle opening machines. Further, since cap removal is carried out as if the crown caps 24 are peeled off, utilizing the increasingly widened distance between the rotary movement track of the cap removing sections 28 and the linear movement track of the head portion of the bottles 23, the hitherto known principle of leverage for opening crown caps is applicable and thereby it is ensured that cap removal operation is carried out continuously and smoothly. As a result damage or chipping on the bottle head which tends to often take place during cap removal is effectively prevented.

Figure 10:
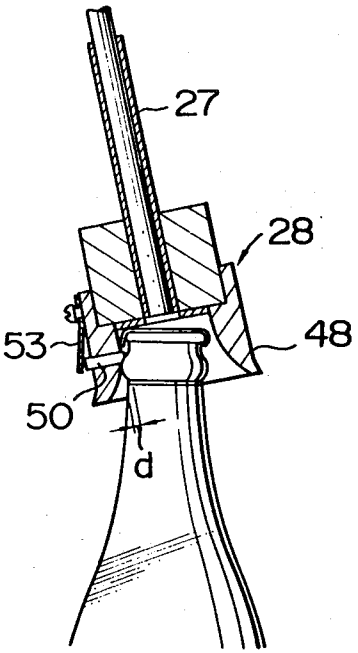
FIG. 10 is a partially sectioned side view of the cap removing portion, illustrating that it is brought into improper engagement with the bottle opening rim.

Cap removal is normally carried out by way of the steps as illustrated in FIGS. 9(A), (B) and (C) and there is no necessity for retracting the pawl 50 against the resilient force of the leaf spring 53 during the cap removal. In case when incorrect engagement of the part 28 with the head of the bottle occurs for any reason, the pawl 50 is caused to move backward, for instance, by a distance d as illustrated in FIG. 10 whereby a certain extent of the incorrect engagement can be compensated by way of the backward displacement of the pawl 50.

It should be noted that the synchronizing mechanism 33 undertakes the function of the synchronizing discs 30 when the latter fail to be engaged to the upper end part of the bottle case 20 or they are disengaged therefrom for any reason. The synchronizing mechanism 33 may be not required in dependence on some factors such as the length of the bottle case 20, the diameter of the synchronizing disc 30 or the like. When the synchronizing recess 31 on the synchronizing disc 30 or the synchronizing recess 36 on the synchronizing mechanism 33 is engaged to the rear end of the preceding bottle case and the fore end of the following one simultaneously, the synchronizing disc 30 or the synchronizing mechanism 33 is subjected to line pressure which is transmitted from the roller conveyor via the bottle case. Accordingly, the cap removing parts are rotationally driven by the aforesaid line pressure.

Figure 11:
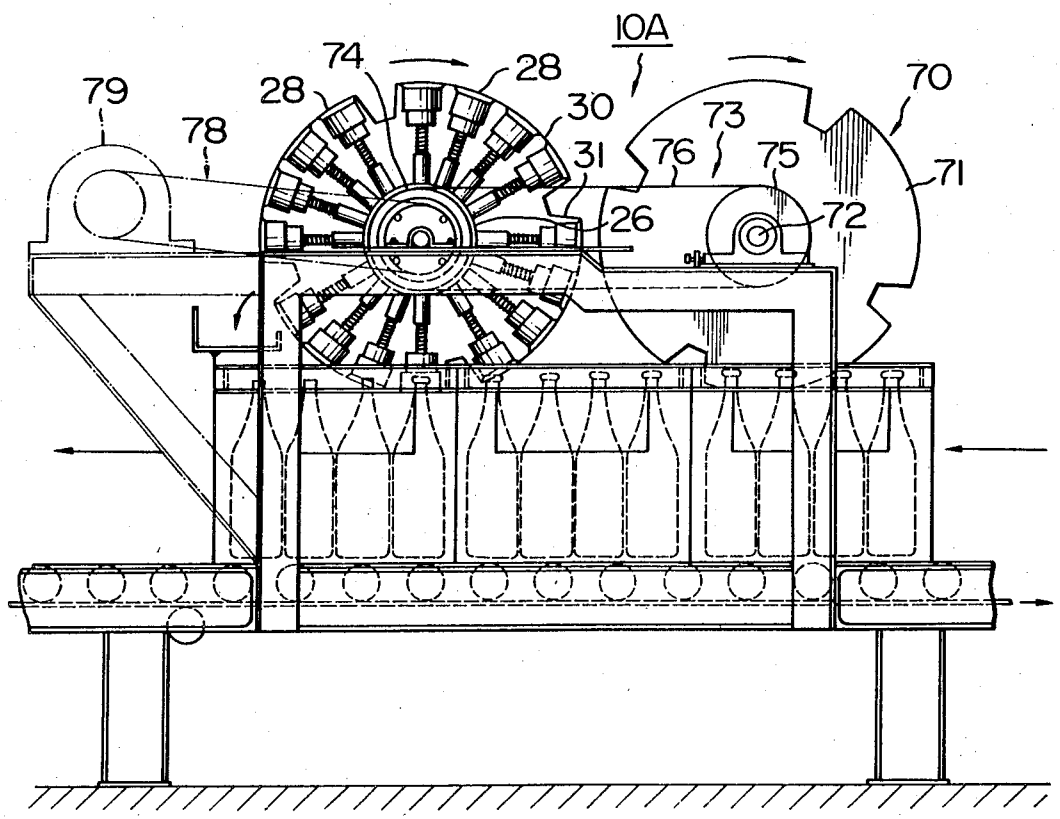
FIG. 11 is a side view of a bottle opening machine in accordance with the first modified embodiment of the present invention.
Figure 12:
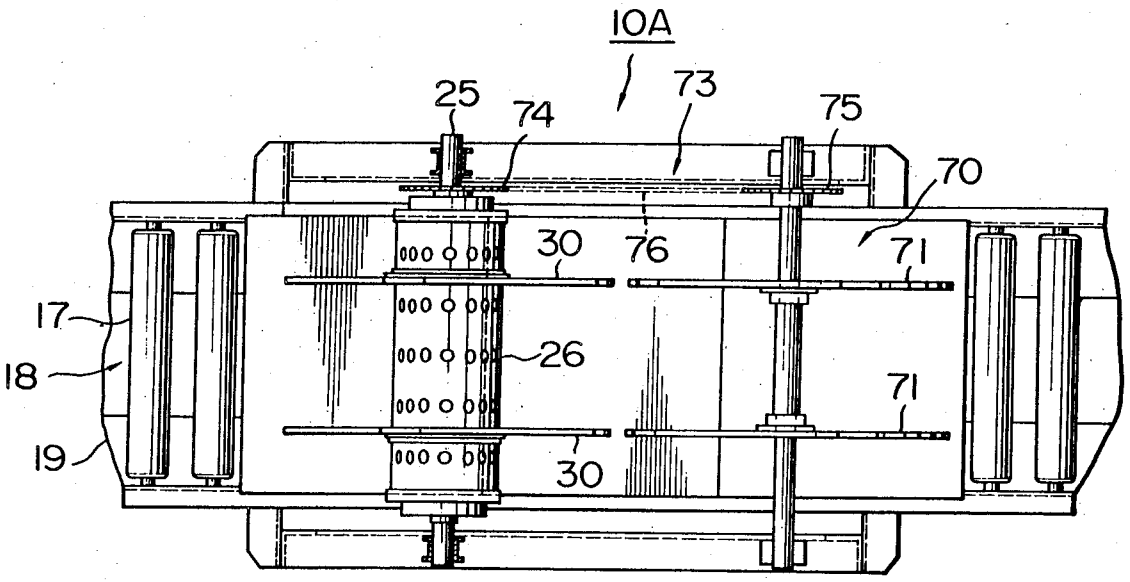
FIG. 12 is a plan view of the bottle opening machine in FIG. 11 without the arms and the cap removing parts.

Next, the bottle opening machine in accordance with the first modified embodiment of the invention will be described in a greater detail with reference to FIGS. 11 and 12.

The bottle opening machine 10A as illustrated in the drawings is substantially same as that in the foregoing embodiment with the exception that the synchronizing plate in the foregoing embodiment is replaced with a synchronizing disc 71 on the synchronizing mechanism 70. Thus, the same or similar parts or components are indicated by the same reference numerals as those in the foregoing and therefore their repeated description will be not required.

Specifically, the synchronizing discs 71 on the synchronizing mechanism 70 are constructed in the same configuration and dimensions as those of the synchronizing disc 30 fixedly mounted on the cylindrical rotary drum 26 and a rotary shaft 72 on which the synchronizing discs 71 are fixedly mounted is connected to the cylindrical drum 26 via a power transmission mechanism 73 comprising sprockets 74 and 75 and an endless chain 76 in the illustrated embodiment so that both the synchronzing disc 71 and the cylindrical drum 26 are rotated in a synchronous relation. It should be noted that in the illustrated embodiment the synchronizing discs 71 are rotated through one revolution while the cylindrical drum 26 is rotated through one revolution.

The cap removing parts 28 on the bottle opening machine 10A are adapted to be rotated by the line pressure in the same manner as in the foregoing embodiment, but as required, the bottle opening machine 10A may be operated by driving power transmitted from a driving mechanism 79 which is connected to the cylindrical drum 26 via another power transmission mechanism 78.

Figure 13:
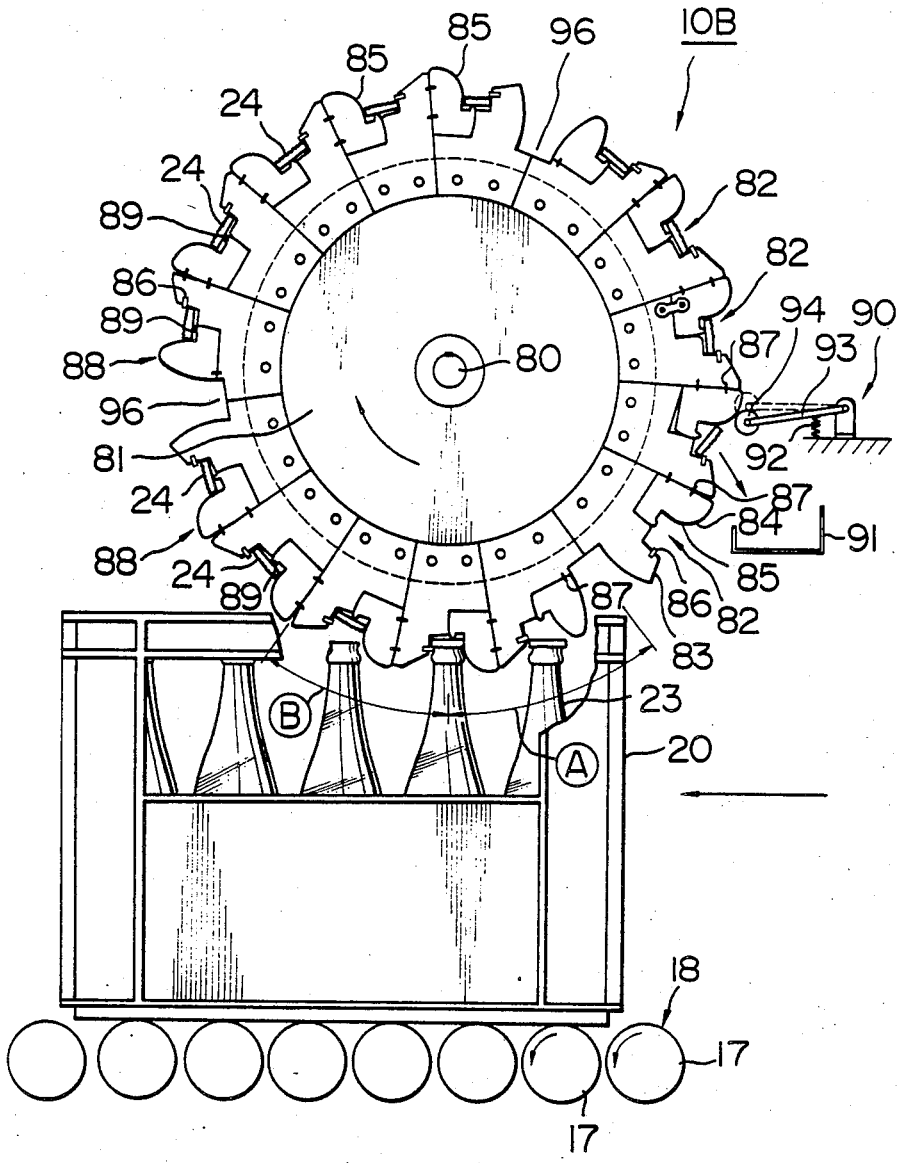
FIG. 13 is a partial side view of a bottle opening machine in accordance with the second modified embodiment of the present invention, illustrating an essential part of the machine.
Figure 14:
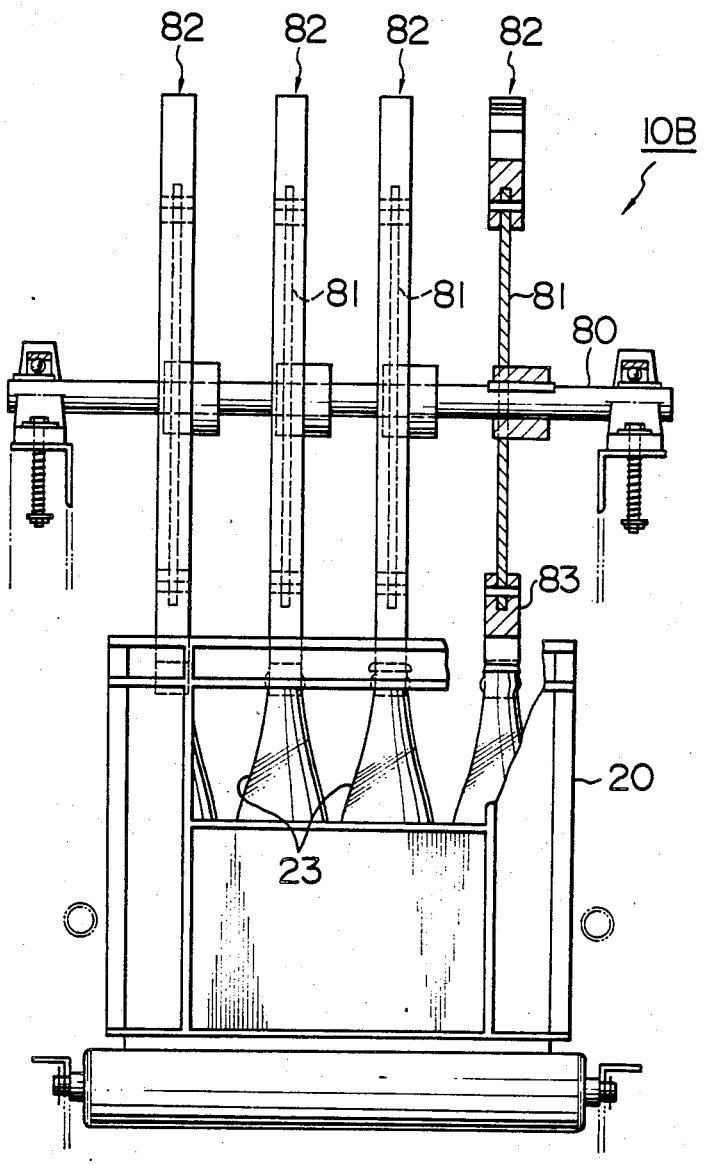
FIG. 14 is a front view of the bottle opening machine as seen from the right side in FIG. 13.

Next, FIGS. 13 and 14 illustrate a bottle opening machine in accordance with the second modified embodiment of the invention.

The bottle opening machine 10B in accordance with the second modified embodiment is constructed such that four rotary discs 81 are fixedly mounted on a shaft 80 which is rotatably supported by means of bearings and a plurality of cap removing parts 82 are arranged in the circumferential direction around said rotary disc 81.

Each of the cap removing parts 82 comprises a finger block which includes a cap removing head 83 fixed to the rotary disc 81 and a guide head 84 jointed to the cap removing head 83, wherein a guide face 85 is formed between both the heads 83 and 84 in such a manner to extend divergently in the radial direction. On the inside wall of the cap removing head 83 is disposed a pawl 86 which projects towards the guide surface 85 therefrom. It should be noted that a suitable resilient means may be provided so as to allow the pawl 86 to be projected adjustably.

The guide head 84 is normally urged toward the cap removing head 83 by means of springs 87 disposed on the rear face thereof so that the crown cap 24 removed from the opening rim of the bottle is firmly held between the pawl 86 and the guide head 84 under the resilient force imparted by the springs 87. Thus, a crown cap holding mechanism 88 is constructed by a combination of the guide head 84, the pawl 86 and the springs 87 so as to ensure that the crown cap 24 is held after completion of removal.

On the bottom of the guide face 85 of the guide head 84 is formed a projection 89 which is adapted to be engaged to the top face of the crown cap 24 when the latter is removed from the bottle head by way of cooperation of the projection 89 with the pawl 86. Thus, cap removal is carried out in the substantially same manner as in the foregoing embodiment as illustrated particularly in FIGS. 6 to 9 and therefore repeated description will be not required any longer.

After completion of removal from the bottle opening rim, the crown cap 24 is transferred while it is held by means of the cap holding mechanism 88, until a crown cap releasing mechanism 90 is actuated and thereby it is discharged from the cap holding mechanism 88 into a crown cap receiving basin 91.

The cap releasing mechanism 90 includes a releasing rod 93 held pivotally about a fulcrum by means of a coil spring 92 and an engagement roller 94 rotatably held on the free end of said releasing rod 93 which is adapted to be engaged with the guide head 84. As the rotary disc 81 is rotated and thereby the guide head 84 is brought into contact with the engagement roller 94, the guide head 84 is caused to turn in the counterclockwise direction (as seen in FIG. 13) against the resilient force of the springs 87 whereby the guide face 85 becomes opened more widely. At this moment the projection 89 on the bottom of the guide head 84 becomes effective to push the top face of the crown cap 24 in the outward direction and thereby the latter is readily released from the cap removing section 82. After the crown cap 24 is discharged into the cap receiving basin 91, the empty cap removing part 82 is rotated further until it is ready to start the next operation.

In predetermined positions in the circumferential direction of the disc 81 are formed synchronizing recesses 96 each of which is adapted to be engaged to the rear end of the preceding bottle case and the fore end of the following bottle case on the roller conveyor at the same time. Owing to the arrangement of the synchronizing recesses 96 it is ensured that each of the cap removing parts 82 (finger blocks) is correctly allocated to one of the bottle heads of the bottles 23.

As described above, the bottle opening machine in accordance with the present invention is constructed such that cap removal is carried out by way of engagement of a crown cap to a cap removing part in an area where the linear movement track of the bottle heads and the circular movement track of the cap removing parts are united with one another in the tangential relation, subsequent removal of the crown caps from the bottle heads and final releasing of the removed crown caps from the cap removing parts, wherein the aforesaid removal is effected by a moment which is caused by the circular movement track being gradually parted away from the linear movement track as the bottle cases are conveyed on the conveyance system. Thus, cap removing is achieved merely by the circular movement of the cap removing parts whereby the intended cap removing operation is carried out smoothly and continuously at a high efficiency.

Since cap removing is effected merely by way of the circular movement of the cap removing parts there is no necessity for a complicated mechanism for raising and lowering cap removers during cap removing operation, a bottle neck retainer for depressing a bottle neck during the same or the like each of which is essential for the conventional bottle opening machine whereby the bottle opening machine can be constructed in a simple structure. Further, since releasing of the removed cap is effected by way of increase in distance caused as the circular movement track is parted away from the linear movement track, cap releasing is very smooth with no danger of causing a damage or chipping on the bottle heads. Furthermore, a reduced amount of power is consumed for cap removing and releasing operations.

Since each of removed caps is held by means of the cap holding mechanism and then discharged into a cap receiving basin by means of the cap releasing mechanism, there is no fear of scattering the removed caps around the bottle opening machine. Thus, removed crown caps are recovered at a high efficiency.

Further, since the respective cap removing parts are operated merely by way of their circular movement and they are caused to be rotatably driven under line pressure which is generated by engagement of them to bottles contained in a bottle case, there is no necessity for any driving mechanism for forcibly driving the cap removing parts. Another advantage of the present invention is that crown caps can be continuously removed from empty bottles contained in a bottle case without any specific power consuming cap removing mechanism.

What is claimed is:

1. A bottle opening machine for removing crown caps from bottle heads of empty bottles contained in bottle cases which are conveyed on a conveyance system one after another in an end-to-end relation, essentially comprising:

a rotary shaft mounted over a path for the bottle cases on a frame structure and extending perpendicular to the flowing direction of the bottle cases;

a plurality of rotary members mounted on the rotary shaft at a space interval corresponding to a distance between two adjoining lines of bottles;

a plurality of cap removing parts disposed circularly around the periphery of each rotary member so that they can be engaged with the respective heads of the bottles in the bottle cases at a predetermined position, each of the cap removing parts including a pawl means adapted to be engaged to the crown caps capped on them; and synchronizing means for causing each cap removing part to engage with the head of each bottle in each bottle case in a synchronous relationship, the synchronizing means being rotatably provided over the path for the bottle cases and having at least one synchronizing recess which is adapted to be simultaneously engaged with the rear end of the preceding bottle case and the fore end of the following bottle case so that the synchronizing means is rotated under the influence of line pressure transmitted by the conveyance system via the bottle cases, and means for transmitting the rotation of the synchronizing means to the rotary shaft, the synchronizing means rotated under the influence of line pressure which is transmitted by the conveyance system and being located with respect to the rotary shaft so that the revolution of the synchronizing means causes the revolution of the rotary shaft, cap removing operation being carried out by way of engagement of each pawl means to the crown caps in an area where the linear movement track of the bottle heads of the bottles contained in the bottle cases and the circular movement track of the pawl means on the cap removing parts are united with one another in the tangential relation to exert a moment on the caps thereby to remove them from the head of the bottles which moment is caused due to the gradually increased distance by which the circular movement track is parted away from the linear movement track past the aforesaid area as the bottle cases are conveyed further on the conveyance system.

2. A bottle opening machine according to claim 1, wherein each rotary member comprises a plurality of arms extending in the radial direction relative to the rotary shaft, each cap removing part is disposed at the free end of each arm.

3. A bottle opening machine according to claim 1, wherein each rotary member comprises a rotary disc which is fixedly provided with respect to the rotary shaft, the cap removing parts being disposed along the periphery of the disc.

4. A bottle opening machine according to claim 3, wherein each of the cap removing parts comprises a finger block disposed along the periphery of the rotary disc, said finger block including a cap removing head fixedly secured to the rotary disc and having a pawl means embedded therein and a guide head jointed to said cap removing head so that a guide face is formed therbetween in such a manner as to diverge in the radial direction, said guide head being normally urged toward the pawl means on the cap removing head with the aid of spring means.

5. A bottle opening machine according to claim 4, wherein the rotary disc has a plurality of synchronizing recesses between the adjacent groups of finger blocks.

6. A bottle opening machine according to claim 2, wherein a rotary drum is mounted on the rotary shaft and includes at least one synchronizing disc on which synchronizing recesses are formed in an equally spaced relation.

7. A bottle opening machine according to claim 1, wherein the synchronizing means is rotatably mounted on the frame structure at the upstream position relative to the rotary members on which the cap removing parts are disposed, the rotation of the synchronizing means being then transmitted to the rotary shaft via an endless chain as the transmitting means.

8. A bottle opening machine according to claim 1, wherein the synchronizing means are provided both on the rotary shaft and at the upstream position relative to the rotary shaft, the synchronizing means at the upstream position being connected to the rotary shaft via an endless chain as the transmitting means.

9. A bottle opening machine according to claim 1, wherein each of the cap removing parts include a cap holding mechanism disposed therein for holding a removed crown cap, a cap releasing mechanism for releasing it at a predetermined position against the holding force of said cap holding mechanism and a cap receiving means for receiving the crown caps discharged by said cap releasing mechanism.

* * * * *